United States Patent [19]

Pomroy

[11] 4,265,068

[45] May 5, 1981

[54] SECURITY PANEL DOOR

[75] Inventor: Michael F. Pomroy, Oshkosh, Wis.

[73] Assignee: Combustion Engineering, Inc., Windsor, Conn.

[21] Appl. No.: 23,121

[22] Filed: Mar. 23, 1979

[51] Int. Cl.[3] ..... E06B 3/26

[52] U.S. Cl. ..... 52/456

[58] Field of Search ..... 52/455, 456, 824, 314, 52/313, 316; D25/85; 144/309 N, 309 P, 309 Q

[56] References Cited

U.S. PATENT DOCUMENTS

| | | | |
|---|---|---|---|
| 632,700 | 9/1899 | Cronin | 52/456 |
| 1,867,575 | 7/1932 | Loetscher | 144/309 N |
| 3,731,443 | 5/1973 | Zaroor | 52/445 |
| 3,829,337 | 8/1974 | Cheng | 144/309 Q |

*Primary Examiner*—John E. Murtagh

*Attorney, Agent, or Firm*—Arthur E. Fournier, Jr.

[57] ABSTRACT

A security panel door of wooden construction, which is characterized by its ability to successfully meet established security test criteria that have been promulgated under existing official building codes, and a method of construction thereof. The subject security panel door embodies a pair of stiles, at least a top rail and a bottom rail, and at least one panel member. One of the longitudinally extending side edges of each of the pair of stiles has first joint means formed therein. The latter first joint means each include at least a first portion and a second portion, with the aforesaid first portion being larger than the aforesaid second portion in at least one dimension. Both the top rail and the bottom rail have a second joint means formed in one of the longitudinally extending side edges thereof. Each of the second joint means includes at least a first portion and a second portion, with the first portion being larger than the second portion in at least one dimension. The panel member is provided with third joint means formed in one pair of the longitudinally extending side edges thereof, and fourth joint means formed in the other pair of the longitudinally extending side edges thereof. The third joint means of the panel member is complementary in configuration to the configuration of the first joint means formed in the pair of stiles, and the fourth joint means is complementary in configuration to the configuration of the second joint means formed in the top and bottom rails. In accordance with the method of construction of the subject security panel door, the panel member is joined to the pair of stiles through the interconnection of the first and third joint means, and the panel member is joined to the top and bottom rails through the interconnection of the second and fourth joint means.

11 Claims, 4 Drawing Figures

SECURITY PANEL DOOR

BACKGROUND OF THE INVENTION

This invention relates to doors and to methods of construction thereof, and more particularly, to a form of wooden panel door and to a method of constructing the latter.

It has long been known in the prior art to employ a door as the means by which the closing and the opening of an entrance way is effected. More specifically, doors have long been used for this purpose irrespective of whether the entrance way to be equipped with a door is intended to function as a passageway through which entry is gained to the interior of a structure from the exterior thereof, or as a passageway through which various interior portions of the same structure are interconnected. The doors, which are employed in conjunction with the former type of entrance way, are normally referred to as exterior doors, whereas those, which are employed in conjunction with the latter type of entrance way, are referred to as interior doors.

In addition to the foregoing manner of classifying doors, i.e., as being either an exterior door or an interior door, there exists numerous other ways in which doors may be classified. For instance, doors may be classified according to the material of which they are constructed. In this regard, materials of a varied nature have long been employed in the construction of doors. One of these materials is wood.

Another way in which doors can be classified is according to intended function. Namely, there can be found in the prior art screen doors, which permit air flow therethrough and are thus particularly suited for employment during periods of warm weather; storm doors, which prevent air flow therethrough and are thus particularly suited for employment during periods of cold weather; combination doors, which can accommodate interchangeable panels whereby the doors may be made to function either in the manner of a screen door or in the manner of a storm door; etc.

Still another way of classifying doors is according to their architectural design. In recent years, it has become more and more common to find available on the market doors of sufficiently varying architectural styling that it is now virtually possible often times to select for employment in a given building a door that conforms in appearance, i.e., design to the architectural style of that particular building.

The availability of such a multiplicity of different styles of doors is attributable at least in part to the employment in the construction of these doors of panels of differing designs. Namely, in most of these instances the overall appearance of the door is established in large measure by the nature, i.e., the styling, of the individual panels, which have been utilized in the door. More specifically, from an economical standpoint, it is known to be measurably less expensive to effect the styling of a door through the appropriate selectivity of varied designs of individual door panels rather than to attempt to custom design each individual door to conform to the particular architectural styling of a given structure. This may explain, at least partially, the increased usage of panel doors that is known to have been occurring. By way of definition, the term "panel door" as used herein is intended to encompass all doors, but particularly those of wooden construction, which embody one or more individual members that are supportable in a frame structure which is formed by the stiles and the rails of the door.

Although many benefits are known to flow from the usage of panels in the construction of doors, there is also at least one notable unfavorable feature associated with the employment thereof in the manner referred to in the foregoing description. Reference is had here to the fact that such panels have been found to lack strength. Namely, from the standpoint of security, the panel represents the weakest portion of the door. Thus, where unauthorized entry is effected through breakage of the door, it is commonly been found that a rupture of the panel has occurred at the point where the panel is joined to its surround components, i.e., the stiles and/or rails of the door, etc. The reason for this is that in accordance with conventional practice, the side edges of the panel are normally machined so as to produce thereat a tenon, i.e., a portion of reduced thickness. Consequently, although the main segments of the panel may be capable of successfully withstanding the impact to which it is subjected in the course of an attempt at forcible entry through a typical door embodying such panels, the areas of the panel which have been machined to produce the aforementioned tenons frequently will break away because there is relatively little material left at these locations.

More and more concern has been evidenced at all levels of government, i.e., federal, state and local, concerning the matter of security and this is led to the adoption thereby of legislation and/or building codes specifying stricter requirements regarding the security aspects of the building components to be utilized particularly in residential structures. This in turn has led to the establishment of stricter security test criteria, which doors, including panel doors, desirably must pass in order to receive certain approvals relating to their potential usage in various types of building structures. In recognition of the existence of such security test criteria, efforts have been made towards providing a door capable of meeting such new security test criteria. However, notwithstanding such efforts on the part of the prior art, a need has still been shown to exist for a wooden panel door that would incorporate therein the best features of appearance or aesthetics as well as the best features of strength or security.

In the way of a brief summary, as more stringent building codes and legislation are adopted, the security aspects of existing residential building components are being increasingly assailed thereby. Namely, cognizance is being taken of the fact that wood doors constitute a major area through which forced entry into a building is achieved. Moreover, recognition is being given to the fact that the security effectiveness of such doors has been reduced over the years as a consequence of the manner in which materials are now being utilized in the construction of these doors and as a consequence of the implementation of certain cost saving steps relative thereto. Relative to this point, reference is had here by way of illustration to the now generally accepted practice employed in the industry of thinning up the cross-sections of the panels, which are being used in these doors.

It should now be readily apparent from the above that the additional requirements being imposed by the newly adopted building code legislation poses a serious problem insofar as concerns the capability of wood doors to comply therewith. This stems principally from both the nature of the material and typical manufacturing processes utilized in the construction thereof. For instance, typical door panels are being machined to approximately ¼ inch thickness at the narrow end thereof, whereby little is being left to resist breakage at this location. Moreover, even when thicker panels made of solid wood are employed, they have proven in the past to be susceptible to both cracking and breaking. In an effort to improve the strength of present door panels, it has been known to make panels with crossband laminations. For the same purpose, doors have been produced embodying flat panels of ¼ inch plywood. However, even though improvements in the strength of the door panels have been achieved through the usage of crossband laminations, and plywood panels, as well as some cost savings also in the case of the plywood panels, the surrounding components, i.e., the stiles and the rails of the door have continued to show failure in those areas where wood has been machined away for aesthetic reasons.

Thus, there has been established in the prior art a need for an improved panel door that embodies a construction which combines the best features of appearance and strength. In accordance with the present invention, there has been provided such a door. More specifically, a panel door has been provided, in which a notable improvement in the strength performance of the panels utilized therein has been achieved. Moreover, the nature of the panels being utilized therein presents a significantly better appearance in terms of both shadowline and aesthetics when compared to previously existing forms of door panels. In addition, the susceptibility of door panels to crack from natural stress, which is a trait that prior art forms of door panels are known to exhibit, has been reduced measurably in the case of the panels of the door of the present invention. Also, as regards another problem or shortcoming of prior art forms of panel design, i.e., the susceptibility of the panels embodied therein to undergo movement, this undesirable characteristic thereof has been significantly reduced in the case of the panels of the door of the present invention. This has been achieved as a consequence of the fact that the latter panels, as a characteristic thereof, embody more dimensional stability. Most importantly, however, the panel door of the present invention is advantageously characterized in the fact that it embodies a superior capability to successfully pass the security test criteria as established by the International Congress of Building Officials Building Code (I.C.B.O. Chapter 41). Heretofore, it has been demonstrated that a typical door of prior art construction will generally fail to pass the aforesaid security test criteria approximately 50 percent of the time as a result of the occurrence therein of either panel failure or surround component, i.e., stile and/or rail, failure.

It is therefore an object of the present invention to provide a new and improved door of wooden panel construction, and a method of construction thereof.

It is another object of the present invention to provide such a door, which is particularly suited for employment as an exterior door to effect the closing and the opening of an entrance way that functions as a passage between the exterior and the interior of a dwelling unit.

It is still another object of the present invention to provide such a door, which is advantageously characterized in the strength that it exhibits, as well as the fact that it combines the best features of appearance with those of strength.

A further object of the present invention is to provide such a door, which embodies panels that are of a particular construction.

A still further object of the present invention is to provide such a door embodying panels that are operative by virtue of their increased thickness to provide the door with an increase of 15% to 20% in the insulative value thereof as compared to the insulative value of panel doors of conventional construction.

Yet another object of the present invention is to provide such a door, the construction of which is effected through the employment of special joinery techniques.

Yet still another object of the present invention is to provide such a door, which is capable of satisfying the security test criteria set by official building codes, while concomitantly retaining the functionality and pleasing appearance associated with panel doors.

SUMMARY OF THE INVENTION

In accordance with one aspect of the present invention, there is provided a security panel door of wooden construction, which is characterized by its ability to successfully meet established security test criteria that have been promulgated under existing official building codes. The subject security panel door embodies a pair of stiles, at least a pair of rails, and at least one panel member. Each of the pair of stiles is provided in one of the longitudinally extending side edges thereof with first joint means. Each of the first joint means includes a first portion, and a second portion located in contiguous relation to the first portion. The first portion consists of a first rabbeted groove, and the second portion consists of a second rabbeted groove. The second rabbeted groove is coaxially aligned with the first rabbeted groove and is of lesser width than the first rabbeted groove. The pair of rails each have a second joint means provided in one of the longitudinally extending side edges thereof. Each of the second joint means includes a first portion and a second portion with the second portion being located in contiguous relation to the first portion. The first portion of the second joint means comprises a first rabbeted groove, and the second portion of the second joint means comprises a second rabbeted groove, with the latter being coaxially aligned with the former and being of a lesser width than the former. One of the pairs of longitudinally extending side edges of the panel member is provided with third joint means, while fourth joint means are provided in the other pair of longitudinally extending side edges of the panel member. The third joint means consists of first and second portions located in abutting relation one to another, and with one of the first and second portions thereof comprising a first tenon suitably dimensioned so as to be receivable in the second rabbeted groove of the first joint means and the other one of the first and second portions thereof comprising a portion complementary in configuration and dimensions to the first rabbeted groove of the first joint means so as to be receivable therewithin when the first tenon is received in the second rabbeted groove of the first joint means. Similarly, the fourth joint means consists of first and second portions located in abutting relation one to another, and with one of the first and second portions thereof comprising a second tenon suitably dimensioned so as to be receivable in the second rabbeted groove of the second joint means and the other one of the first and second portions thereof comprising a portion complementary in configuration and dimensions to the first rabbeted groove of the second joint means so as to be receivable therewithin when the second tenon is received in the second rabbeted groove of the second joint means. The first and third joint means are operative to effect the joining of the panel member to the pair of stiles, and the second and fourth joint means are operative to effect the joining of the panel member to the pair of rails. With the panel member so joined to the pair of stiles and to the pair of rails, the completion of the construction of the subject security panel door is accomplished by securing the panel member in joined relation to the pair of stiles and the pair of rails through the use of suitable securing means.

In accord with another aspect of the present invention, there is provided a method for constructing a wooden security panel door, the latter being characterized by its ability to successfully meet established security test criteria that have been promulgated under existing official building codes. The subject method includes the steps of providing a first stile having a pair of coaxially aligned rabbeted grooves of differing dimensions formed in one of the longitudinally extending side edges thereof, providing a second stile having a pair of coaxially aligned rabbeted grooves of differing dimensions formed in one of the longitudinally extending side edges thereof, providing a first rail having a pair of coaxially aligned rabbeted grooves of differing dimensions formed in one of the longtitudinally extending side edges thereof, providing a second rail having a pair of coaxially aligned rabbeted grooves of differing dimensions formed in one of the longitudinally extending side edges thereof, providing at least one panel member having formed in each of one pair of longitudinally extending side edges thereof a first tenon and a portion associated therewith embodying the configuration and dimensions of one of the pair of rabbeted grooves formed in each of the first and second stiles and having formed in each of the other pair of longitudinally extending side edges thereof a second tenon and a portion associated therewith embodying the configuration and dimensions of one of the pair of rabbeted grooves formed in each of the first and second rails, assembling the panel member with the first and second stiles by inserting the first tenons and complementary portions associated therewith into the pair of rabbeted grooves formed in each of the first and second stiles, assembling the panel member with the first and second rails by inserting the second tenons and complementary portions associated therewith into the pair of rabbeted grooves formed in each of the first and second rails, and with the panel member joined to the first and second stiles and to the first and second rails employing securing means to secure the panel member in place relative thereto.

DESCRIPTION OF A PREFERRED EMBODIMENT

Figure 1:
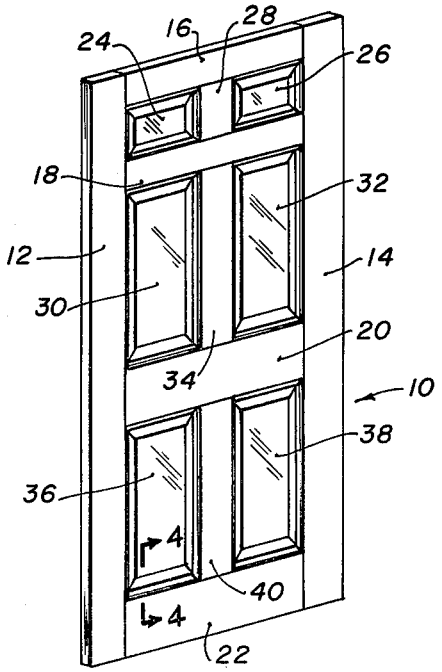
FIG. 1 is a perspective view of a security panel door constructed in accordance with the present invention.

Referring now to the drawing, and more particularly to FIG. 1 thereof, there is illustrated therein a security panel door, generally designated by reference numeral 10, constructed in accordance with the present invention. As depicted in FIG. 1, the door 10 is of wood construction and embodies a pair of stiles 12 and 14, a top rail 16, an intermediate rail 18, a lock rail 20, a bottom rail 22, a pair of relatively small upper panel members 24 and 26, a mullion 28 interposed between the panel members 24 and 26, a pair of relatively large intermediate panel members 30 and 32, a mullion 34 interposed between the panel members 30 and 32, a pair of relatively large lower panel members 36 and 38, and a mullion 40 interposed between the panel members 36 and 38. For purposes of setting forth herein a description of the invention, a particular embodiment of security panel door 10 has been depicted in the drawing. Namely, as shown in FIG. 1, the panel door 10 embodies six panel members 24, 26, 30, 32, 36 and 38, i.e., two small panel members 24 and 26 and four large panel members 30, 32, 36, and 38, which function to give the panel door 10 a distinctive styling. However, it is to be understood that a greater or a lesser number of panel members could be employed in the panel door 10 without departing from the essence of the present invention. In addition, the size and/or configuration of the individual panel members could be modified from that depicted in FIG. 1, e.g., all of the panel members could be of substantially the same size in the panel door 10 and/or the panel members rather than being rectangular in configuration could be triangular in shape, whereupon the mullions associated therewith would extend diagonally rather than vertically relative to the longitudinal axis of the panel door 10, without departing from the essence of the present invention. Other styling changes affecting the overall appearance of the panel door 10 could likewise be made therein without departing from the essence of the present invention. In summary, it is to be understood that the particular style embodied by the panel door 10 in FIG. 1 of the drawing is intended to be merely representative of one of the many different styles, which a security panel door 10 constructed in accordance with the present invention might embody.

Inasmuch as each of the individual panel members 24, 26, 30, 32, 36 and 38 is assembled in joined relation to the surround components associated therewith, i.e., the corresponding surround components selected from the stiles 12, 14; the rails 16, 18, 20, 22; and the mullions 28, 34, 40; in an identical manner, it is deemed sufficient for purposes of obtaining an understanding of the present invention to merely set forth hereinafter a description of the manner in which one of the panel members 24, 26, 30, 32, 36 and 38 is joined to its corresponding surround components. To this end and with particular reference to FIGS. 2–4 of the drawing, there will now be set forth a description of the joinery techniques employed in the construction of the security panel door 10 in accordance with the present invention for purposes of effecting the assembly of the panel member 36 with its corresponding surround components; namely, the stile 12, the bottom rail 22, the mullion 40 and the lock rail 20.

Turning first to a consideration of the nature of the construction of the stile 12, the latter comprises an elongated member that extends the entire length of the panel door 10. Moreover, as best understood with reference to FIG. 2, the stile 12 in accordance with the illustrated embodiment thereof includes a main body section 42. The latter section 42 may either be composed of a multiplicity of different pieces of wood, in the manner depicted in FIG. 2, which are suitably secured together such as by gluing to form an integral member of the desired dimensions, i.e., embodying the length, width and thickness desired, or the section 42 may take the form of one entire solid piece of wood (not shown) without departing from the essence of the present invention. Affixed to the longitudinally extending outside edge of the main body section 42, such as by being glued thereto, there is preferably provided an end piece 44 that extends the entire length of the panel door 10, and which has a width substantially equivalent to the thickness of the section 42.

Continuing with a description of the stile 12, the latter is additionally preferably provided with a pair of veneer strips 46 and 48, which extend substantially the entire length and width of the stile 12. More specifically, the veneer strips 46 and 48 are preferably glued to the outer side surfaces of the assembly comprised by the section 42 and the end piece 44, and thereby serve to form the external side surfaces of the stile 12. Also, the stile 12 is preferably provided along the other of its longitudinally extending edges, i.e., the edge opposite that to which the end piece 44 is glued, with a strip of molding 52. Although as depicted in the drawing, the molding 52 is in the form of a single strip embodying a width equal to that of the thickness of the stile 12, the molding 52 could also take the form of individual quarter round molding strips (not shown) suitably affixed such as by gluing to the end edge of the section 42. Or, in the case wherein the section 42 takes the form of a solid piece of wood, the molding 52 could be provided as an integral part thereof, without departing from the essence of the present invention.

Figure 2:
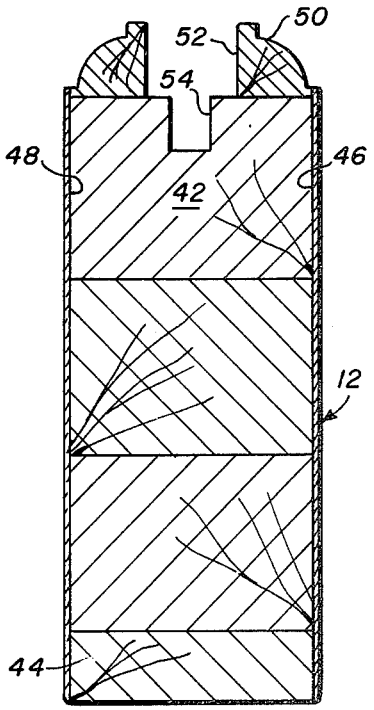
FIG. 2 is a top plan view of one of the stiles employed in a security panel door constructed in accordance with the present invention.

For purposes of effecting the joining of the panel member 36 to the stile 12, the latter in accordance with the present invention is provided with first joint means suitably formed in one of the longitudinally extending side edges thereof. The latter first joint means includes a first portion in the form of a first rabbeted groove 52, and a second portion in the form of a second rabbeted groove 54. As depicted in FIG. 2 of the drawing, the first and second rabbeted grooves 52 and 54, respectively, are contiguous with one another and each extends the entire length of the stile 12. More specifically, the second rabbeted groove 54 is suitably formed in the section 42 so as to be located substantially equidistant from the side surfaces of the latter. Similarly, the first rabbeted groove 52 is suitably formed in the molding 50 so as to be centrally located therein with reference to the side edges thereof. As best understood with reference to FIG. 2, the depth of the groove 52 is preferably equal to the thickness of the molding 50 whereby the groove 52 extends entirely through the molding 50. Insofar as concerns the width of the groove 52, the latter is preferably slightly in excess of twice the width of the groove 54. Finally, with reference to the groove 54, the depth thereof is substantially the same as that of the groove 52. However, as will be set forth more fully subsequently, when the panel member 36 is joined to the stile 12 in a manner yet to be described, the dimensions of the groove 54 are such that the latter is not filled to its entire depth by a cooperating portion of the panel member 36.

The bottom rail 22, as best understood with reference to FIG. 4 of the drawing is similar in configuration and construction to the stile 12 previously described hereinabove. More specifically, the bottom rail 22, as illustrated in FIG. 1, is of sufficient length to span substantially the width of the panel door 10, i.e., so as to extend between the stiles 12 and 14 with one end thereof joined to the stile 12 and the other end thereof joined to the stile 14. Moreover, in accordance with the illustrated embodiment thereof, the bottom rail 22 preferably is made from one single piece of wood. That is, the bottom rail 22 consists of a main body portion 56 and a strip of molding 58 formed integrally therewith. However, it is to be understood that the bottom rail 22, if so desired, could equally well be constructed of a multiplicity of different pieces of wood and/or with a separate strip of molding glued thereto in the manner of the stile 12, without departing from the essence of the present invention.

With further reference to the nature of the construction of the bottom rail 22, the latter is provided in one of its longitudinally extending side edges with second joint means. The latter second joint means, like the first joint means of the stile 12, includes a first portion in the form of a first rabbeted groove 60 and a second portion in the form of a second rabbeted groove 62. As best understood with reference to FIG. 4 of the drawing, the first and second rabbeted grooves 60 and 62, respectively, are contiguous with one another and each extends the entire length of the rail 22. More specifically, the second rabbeted groove 62 is suitably formed in the section 56 so as to be located substantially equidistant from the side surfaces of the latter. In a similar fashion, the first rabbeted groove 62 is suitably formed in the molding 58 so as to be centrally located therein relative to the side edges thereof. As seen with reference to FIG. 4, the depth of the groove 60 is preferably equal to the thickness of the molding 58 whereby the groove 60 extends entirely through the molding 58. Regarding the width of the groove 60, the latter is preferably slightly in excess of twice the width of the groove 62. Finally, as concerns the groove 62, the depth thereof is substantially the same as that of the groove 60. However, note is taken here of the fact that with the panel member 36 joined to the rail 22 in a manner yet to be described, the dimensions of the groove 62 are such that the latter is not filled to its entire depth by a cooperating portion of the panel member 36, for a purpose which will be more fully explained herein subsequently. Note is taken here of the fact that in accord with the best mode embodiment of invention, the first joint means and the second joint means are identical in configuration and dimensions.

Figure 3:
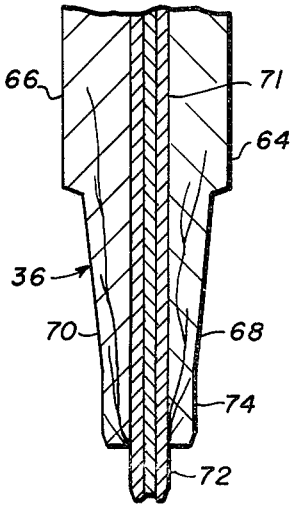
FIG. 3 is a top plan view of a panel member employed in a security panel door constructed in accordance with the present invention.
Figure 4:
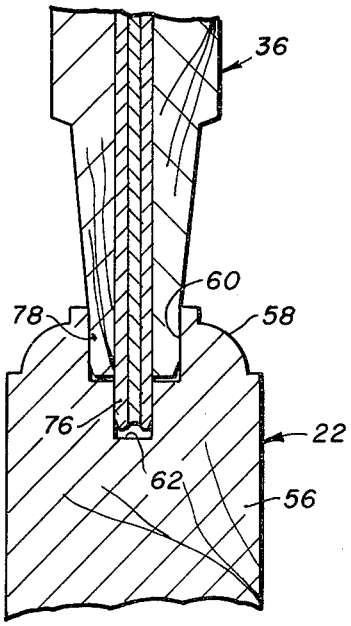
FIG. 4 is a cross-sectional view of a panel member and a rail employed in a security panel door constructed in accordance with the present invention, taken substantially along the line 4—4 in FIG. 1.

Referring once again to the drawing, and more specifically to FIGS. 1, 3 and 4 thereof, a description will now be set forth of the nature of the construction of the panel member 36. As best seen with reference to FIG. 1, the panel member 36 is substantially rectangular in configuration. Moreover, each of the side surfaces of the panel member 36 embodies a raised portion 64 and 66, respectively. Each of the raised portions 64 and 66, in accordance with the illustrated embodiment of the panel member 36, is of the same general configuration as the panel member 36, but differs therefrom in being of slightly smaller dimensions. One of the effects of the raised portions 64 and 66 is to provide the panel member 36 with its distinctive appearance. However, it is to be understood that modifications in the overall appearance of the panel member 36 could be effected through the use of other forms of styling, i.e., differently configured raised portions, without departing from the essence of the present invention. As best understood with reference to FIGS. 3 and 4 of the drawing, intermediate the raised portions 64 and 66 and the edge portions of the panel member 36, each of the side surfaces of the latter is preferably provided with a slight taper 68 and 70, respectively, of suitable dimensions. The aforedescribed raised portions 64 and 66 combine with the aforementioned tapers 68 and 70 to give the panel member 36 a distinctive and accentuated shadowline. Continuing with the structural description of the panel member 36, the latter in accordance with the best mode embodiment of the invention incorporates therein an insert 71. The insert 71 preferably consists of a laminated plywood member, which is suitably secured such as by gluing to the side surfaces embodying the raised portions 64 and 66 of the panel member 36. The insert 71, which is located at the center of the panel member 36 and which is coextensive in circumference with the circumference of the panel member 36, is operative to provide the panel member 36 with significantly increased strength against forced entry through breakage thereof as compared to other panel members, which do not embody such an insert 71.

For purposes of effecting the joinder of the panel member 36 with the surround components associated therewith, i.e., the stile 12, the bottom rail 22, the mullion 40 and the lock rail 20, the panel member 36 is provided along each of one pair of parallel, longitudinally extending side edges thereof with a third joint means, and along each of the other pair of parallel, longitudinally extending side edges thereof with a fourth joint means. As best understood with reference to FIG. 3 of the drawing, each of the third joint means includes a first tenon 72, suitably dimensioned so as to be receivable in the second rabbeted groove 54 of the stile 12, and a first portion 72 located contiguous to the first tenon 72 and suitably dimensioned so as to be receivable within the first rabbeted groove 52 of the stile 12. Additionally, as best depicted in FIG. 4 of the drawing, each of the fourth joint means includes a second tenon 76, suitably dimensioned so as to be receivable in the second rabbeted groove 62 of the bottom rail 22, and a second portion 78 located contiguous to the second tenon 76 and suitably dimensioned so as to be receivable within the first rabbeted groove 60 of the bottom rail 22. It is to be noted here that in accordance with the best mode embodiment of the invention the third joint means and the fourth joint means are identical in configuration and dimensions.

Preferably, in the case of each of the third joint means, the first portion 74 is of slightly longer length than the tenon 72. The reason for this is that when the panel member 36 is being assembled with the stile 12, it is desirable that the first tenon 72 of the panel member 36 be guided to some extent as it enters the second rabbeted groove 54. By making the first portion 74 of the panel member 36 slightly longer than the first tenon 72 thereof, the first portion 74 begins to enter the first rabbeted groove 52, thereby establishing the position of the first portion 74 relative to the side walls of the first rabbeted grooves 52 and concomitantly effecting the alignment of the first tenon 72 with the second rabbeted groove 54, before the first tenon 72 actually begins to enter the latter groove 54. Consequently, with the panel member 36 joined to the stile 12, the first tenon 72 is received in the second rabbeted groove 54 but does not extend to the full depth thereof. This is because of the aforedescribed relationship which exists between the relative dimensions of the first tenons 72, the first portions 74, the first rabbeted groove 52 and the second rabbeted groove 54.

For the same purpose as that described above with reference to the length of the first tenon 72 relative to the depth of the second rabbeted groove 54, the length of each of the second tenons 76 of the fourth joint means of the panel member 36 is preferably made so as to be slightly shorter than the depth of the second rabbeted groove 62 of the bottom rail 22. Likewise, the second portion 78 of each of the fourth joint means of the panel member 36 is preferably formed so as to be slightly longer in length than the second tenons 76.

In accordance with the illustrated embodiment of the panel member 36, each of the first tenons 72 and each of the second tenons 76 thereof is shown as terminating in a bifurcation. However, it is to be understood that the tips of the first tenons 72 and the second tenons 76 could each terminate in a planar configuration, if so desired, without departing from the essence of the present invention.

As has been set forth herein previously, the joinery techniques utilized to effect the joinder of each of the panel members 24, 26, 30, 32, 36 and 38 with its associated surround components are identical. Accordingly, to this end, it is to be understood that the stile 14 as well as each of the mullions 28, 34 and 40 is provided with first joint means identical in construction and function to the first joint means discussed hereinabove and illustrated in FIG. 2 of the drawing with which the stile 12 is provided. Note is also taken of the fact that in the case of each of the mullions 28, 34 and 40, each of the longitudinally extending side edges thereof is provided with first joint means in contrast to both the stile 12 and the stile 14 wherein only one of the longitudinally extending side edges thereof is provided with first joint means. Likewise, it is to be understood that the top rail 16, the intermediate rail 18 and the lock rail 20 are each provided with second joint means identical in construction and function to the second joint means described hereinabove and illustrated in FIG. 4 of the drawing with which the bottom rail 22 is provided. Moreover, in the case of both the intermediate rail 18 and the lock rail 20, each of the longitudinally extending side edges thereof is provided with second joint means in contrast to both the top rail 16, and the bottom rail 22 wherein only one of the longitudinally extending side edges thereof is provided with second joint means. Finally, it is to be understood that each of the panel members 24, 26, 30, 32 and 38 embodies third joint means and fourth joint means identical in construction and in function to the third joint means and the fourth joint means described hereinabove and illustrated in FIGS. 3 and 4 of the drawing with which the panel member 36 is provided.

The construction of the security panel door 10 is effected by assembling the panel members 24, 26, 30, 32, 36 and 38 with their associated surround components; namely, the stiles 12 and 14, the top rail 16, the intermediate rail 18, the lock rail 20, the bottom rail 22 and the mullions 28, 34 and 40. More specifically, the actual joinder of the panel members 24, 26, 30, 32, 36 and 38 with the aforereferenced surround components is accomplished by cooperatively associating the third joint means of each of the aforesaid panel members 24, 26, 30, 32, 36 and 38 with the corresponding first joint means with which the stiles 12 and 14 and the mullions 28, 34 and 40 are each provided as described in the foregoing paragraph, and by cooperatively associating the fourth joint means of each of the aforesaid panel members 24, 26, 30, 32, 36 and 38 with the corresponding second joint means with which the top rail 16, the intermediate rail 18, the lock rail 20 and the bottom rail 22 are each provided as also described in the foregoing paragraph. Once the interengagement of the third joint means of the panel members 24, 26, 30, 32, 36 and 38 with the first joint means of the stiles 12 and 14 and the mullions 28, 34 and 40, and the interengagement of the fourth joint means of the panel members 24, 26, 30, 32, 36 and 38 with the second joint means of the rails 16, 18, 20 and 22 has been effected, suitable securing means are utilized to maintain the interengagement therebetween. In accordance with the best mode embodiment of the invention, the aforesaid securing means preferably takes the form of glue employed in combination with a suitable number of dowels. Namely, the stiles 12 and 14 are each glued to each of the rails 16, 18, 20 and 22. Additionally, dowels (not shown) are employed in the joinder of the stiles 12 and 14 with at least both the top rail 16 and the bottom rail 22, but preferably with all four of the rails 16, 18, 20 and 22. Inasmuch as the use of glue and dowels in the aforedescribed manner is well-known to those skilled in the art, it is not deemed necessary for purposes of obtaining an understanding of the present invention to describe herein the use thereof with any greater degree of specificity.

In actual practice, the assembly of the security panel door 10 is accomplished by placing all of the panel members 24, 26, 30, 32, 36 and 38 and their corresponding surround components on a flat substantially horizontally disposed surface; effecting the alignment of the panel members 24, 26, 30, 32 36 and 38 with their corresponding surround components so as to insure that all of the first tenons 72 and the first portions 74 with which the panel members 24, 26, 30, 32, 36 and 38 are provided are properly aligned with the second rabbeted grooves 54 and the first rabbeted grooves 52, respectively, with which each of the stiles 12 and 14 and mullions 28, 34 and 40 is provided, and that all of the second tenons 76 and second portions 78 with which each of the panel members 24, 26, 30, 32, 36 and 38 is provided are properly aligned with the second rabbeted grooves 62 and the first rabbeted grooves 60, respectively, with which each of the rails 16, 18, 20 and 22 is provided; disposing glue on the appropriate interengaging surfaces of the stiles 12 and 14, and the rails 16, 18, 20 and 22; interposing dowels between abutting components where appropriate; and applying suitable force to the exterior frame defined by the stiles 12 and 14, the top rail 16 and the bottom rail 22 of the security panel door 10 to effect the desired interengagement of the aforereferenced third joint means with the first joint means and the aforereferenced fourth joint means with the second joint means with the aforedescribed glue and dowels thereafter, i.e., after removal of the aforereferenced suitable force, being operative to maintain the desired interengagement of the third and fourth joint means with the first and second joint means, respectively.

The present invention also encompasses a method of construction of a wooden security panel door. The subject method in accordance with the present invention includes the steps of providing a plurality of surround components each embodying one or more pair of coaxially aligned rabbeted grooves of differing dimensions formed in the longitudinally extending side edges thereof, providing at least one panel member having formed in each of one pair of longitudinally extending side edges thereof a first tenon and a portion associated therewith embodying the configuration and dimensions of one of the pair of rabbeted grooves formed in some of the plurality of surround components and having formed in each of the other pair of longitudinally extending side edges thereof a second tenon and a portion associated therewith embodying the configuration and dimensions of one of the pair of rabbeted grooves formed in others of the plurality of surround components, assembling the panel member with the plurality of surround components by inserting the first tenons and complementary portions associated therewith into the pair of rabbeted grooves formed in the aforereferenced some of the plurality of surround components and by inserting the second tenons and complementary portions associated therewith into the pair of rabbeted grooves formed in the aforereferenced others of the plurality of surround components, and with the panel member joined to the plurality of surround components employing securing means to secure the panel member in place relative thereto.

Thus, in accordance with the present invention there has been provided a new and improved door of wooden panel construction, and a method of construction thereof. Moreover, the subject door of the present invention is particularly suited for employment as an exterior door to effect the closing and the opening of an entrance way that functions as a passage between the exterior and the interior of a dwelling unit. In addition, in accord with the present invention a door is provided, which is advantageously characterized in the strength that it exhibits. Further, the door of the present invention combines the best features of appearance with those of strength. Additionally, in accordance with the present invention a door is provided, which embodies panels that are of particular construction. Also, the door of the present invention is characterized in that the construction thereof is effected through the employment of special joinery techniques. Finally, in accord with the present invention, a door is provided, which is capable of satisfying the security test criteria set by official building codes, while concomitantly retaining the functionality and pleasing appearance associated with panel doors.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all other modifications, which fall within the true spirit and scope of my invention.

What is claimed is:

1. A security panel door operative for effecting the closing and the opening of a passageway comprising:

(a) a first plurality of surround components made of wood and each having first joint means formed in at least one of the longitudinally extending edges thereof, said first joint means each including a first portion and a second portion, said second portion being located in contiguous relation to said first portion, said first portion consisting of a first rabbeted groove and said second portion consisting of a second rabbeted groove, said second rabbeted groove being coaxially aligned with said first rabbeted groove, said second rabbeted groove being equal in length to said first rabbeted groove and being of a lesser width than said first rabbeted groove;

(b) a second plurality of surround components made of wood and each having second joint means formed in at least one of the longitudinally extending edges thereof, said second joint means each including a third portion and a fourth portion, said third portion being located in contiguous relation to said fourth portion, said third portion consisting of a third rabbeted groove and said fourth portion consisting of a fourth rabbeted groove, said fourth rabbeted groove being coaxially aligned with said third rabbeted groove, said fourth rabbeted groove being equal in length to said third rabbeted groove and being of a lesser width than said third rabbeted groove; and (c) at least one panel member made of wood, said panel member having third joint means formed in each of a first pair of longitudinally extending edges thereof and fourth joint means formed in each of a second pair of longitudinally extending edges thereof, each of said third joint means including first and second portions located in abutting relation one to another, one of said first and second portions of each of said third joint means consisting of a first tenon and the other of said first and second portions of each of said third joint means consisting of a first complementary portion, each of said first tenons embodying a configuration complementary to each of said second rabbeted grooves so as to be receivable therewithin and each of said first complementary portions embodying a configuration complementary to each of said first rabbeted grooves so as to be receivable therewithin, each of said fourth joint means including third and fourth portions located in abutting relation one to another, one of said third and fourth portions of each of said fourth joint means consisting of a second tenon and the other of said third and fourth portions of each of said fourth joint means consisting of a second complementary portion, each of said second tenons embodying a configuration complementary to each of said fourth rabbeted grooves so as to be receivable therewithin and each of said second complementary portions embodying a configuration complementary to each of said third rabbeted grooves so as to be receivable therewithin, said panel member being joined to said first plurality of surround components through the interengagement of said third joint means of said panel member with said first joint means of said first plurality of surround components, said panel member being joined to said second plurality of surround components through the interengagement of said fourth joint means of said panel member with said second joint means of said second plurality of surround components, each of said first complementary portions having a length longer than each of said first tenons so as to enable said first complementary portion to function to guide the insertion of said first tenon into said secone rabbeted groove as said first complementary portion is inserted into said first rabbeted groove, and each of said second complementary portions having a length longer than each of said second tenons so as to enable said second complementary portion to function to guide the insertion of said second tenon into said fourth rabbeted groove as said second complementary portion is inserted into said third rabbeted groove.

2. The security panel door as set forth in claim 1 wherein said panel member incorporates an insert at the center thereof operative to provide said panel member with additional strength.

3. The security panel door as set forth in claim 1 further including securing means operative to maintain said panel member joined to said first plurality of surround components and to said second plurality of surround components.

4. The security panel door as set forth in claim 3 wherein said first plurality of surround components comprises a pair of spaced frame members each having its longitudinal axis extending in a first direction.

5. The security panel door as set forth in claim 4 wherein said second plurality of surround components comprises a pair of spaced frame members each having its longitudinal axis extending in a second direction, said second direction being substantially at right angles to said first direction.

6. A ecurity panel door operable for effecting the closing and the opening of a passageway comprising:

(a) a first plurality of surround components made of wood and each having first joint means formed in at least one of the longitudinally extending edges thereof, said first joint means each including a first portion and a second portion, said second portion being located in contiguous relation to said first portion, said first portion consisting of a first rabbeted groove and said second portion consisting of a second rabbeted groove, said second rabbeted groove being coaxially aligned with said first rabbeted groove, said second rabbeted groove being equal to length to said first rabbeted groove and being of a lesser width than said first rabbeted groove;

(b) a second plurality of surround components made of wood and each having second joint means formed in at least one of the longitudinally extending edges thereof, said second joint means each including a third portion and a fourth portion, said third portion being located in contiguous relation to said fourth portion, said third portion consisting of a third rabbeted groove and said fourth portion consisting of a fourth rabbeted groove, said fourth rabbeted groove being coaxially aligned with said third rabbeted groove, said fourth rabbeted groove being equal in length to said third rabbeted groove and being of a lesser width than said third rabbeted groove; and (c) at least one pair of panel members disposed in side-by-side relation in a common plane, each of said pair of panel members being made of wood and having third joint means formed in each of a first pair of longitudinally extending edges thereof and fourth joint means formed in each of a second pair of longitudinally extending edges thereof, each of said third joint means including first and second portions located in abutting relation one to another, one of said first and second portions of each of said third joint means consisting of a first tenon and the other of said first and second portions of each of said third joint means consisting of a first complementary portion, each of said first tenons embodying a configuration complementary to each of said second rabbeted grooves so as to be receivable therewithin and each of said first complementary portions embodying a configuration complementary to each of said first rabbeted grooves so as to be receivable therewithin, each of said fourth joint means including third and fourth portions located in abutting relation one to another, one of said third and fourth portions of each of said fourth joint means consisting of a second tenon and the other of said third and fourth portions of each of said fourth joint means consisting of a second complementary portion, each of said second tenons embodying a configuration complementary to each of said fourth rabbeted grooves so as to be receivable therewithin and each of said second complementary portions embodying a configuration complementary to each of said third rabbeted grooves so as to be receivable therewithin, said pair of panel members being joined to said first plurality of surround components through the interengagement of said third joint means of said pair of panel members with said first joint means of said first plurality of surround components, said pair of panel members being joined to said second plurality of surround components through the interengagement of said fourth joint means of said pair of panel members with said second joint means of said second plurality of surround components, each of said first complementary portions having a length longer than each of said first tenons so as to enable said first complementary portion to function to guide the insertion of said first tenon into said second rabbeted groove as said first complementary portion is inserted into said first rabbeted groove, and each of said second complementary portions having a length longer than each of said second tenons so as to enable said second complementary portion to function to guide the insertion of said second tenon into said fourth rabbeted groove as said second complementary portion is inserted into said third rabbeted groove.

7. The security panel door as set forth in claim 6 wherein said first plurality of surround components comprises three spaced frame members each having its longitudinal axis extending in a first direction.

8. The security panel door as set forth in claim 7 wherein said second plurality of surround components comprises a pair of spaced frame members each having its longitudinal axis extending in a second direction, said second direction being substantially at right angles to said first direction.

9. A security panel door operative for effecting the closing and the opening of a passageway comprising:

(a) a first plurality of surround components made of wood and each having first joint means formed in at least one of the longitudinally extending edges thereof, said first joint means each including a first portion and a second portion, said second portion being located in contiguous relation to said first portion, said first portion consisting of a first rabbeted groove and said second portion consisting of a second rabbeted groove, said second rabbeted groove being coaxially aligned with said first rabbeted groove, said second rabbeted groove being equal in length to said first rabbeted groove and being of a lesser width than said first rabbeted groove;

(b) a second plurality of surround components made of wood and each having second joint means formed in at least one of the longitudinally extending edges thereof, said second joint means each including a third portion and a fourth portion, said third portion being located in contiguous relation to said fourth portion, said third portion consisting of a third rabbeted groove and said fourth portion consisting of a fourth rabbeted groove, said fourth rabbeted groove being coaxially aligned with said third rabbeted groove, said fourth rabbeted groove being equal to length to said third rabbeted groove and being of a lesser width than said third rabbeted groove; and (c) at least one pair of panel members disposed one above the other in common plane, each of said pair of panel members being made of wood and having third joint means formed in each of a first pair of longitudinally extending edges thereof and fourth joint means formed in each of a second pair of longitudinally extending edges thereof, each of said third joint means including first and second portions located in abutting relation one to another, one of said first and second portions of each of said third joint means consisting of a first tenon and the other of said first and second portions of each of said third joint means consisting of a first complementary portion, each of said first tenons embodying a configuration complementary to each of said second rabbeted grooves so as to be receivable therewithin and each of said first complementary portions embodying a configuration complementary to each of said first rabbeted grooves so as to be receivable therewithin, each of said fourth joint means including third and fourth portions located in abutting relation one to another, one of said third and fourth portions of each of said fourth joint means consisting of a second tenon and the other of said third and fourth portions of each of said fourth joint means consisting of a second complementary portion, each of said second tenons embodying a configuration complementary to each of said fourth rabbeted grooves so as to be receivable therewithin and each of said second complementary portions embodying a configuration complementary to each of said third rabbeted grooves so as to be receivable therewithin, said pair of panel members being joined to said first plurality of surround components through the interengagement of said third joint means of said pair of panel members with said first joint means of said first plurality of surround components, said pair of panel members being joined to said second plurality of surround components through the interengagement of said fourth joint means of said pair of panel members with said second joint means of said second plurality of surround components, each of said first complementary portions having a length longer than each of said first tenons so as to enable said first complementary portion to function to guide the insertion of said first tenon into said second rabbeted groove as said first complementary portion is inserted into said first rabbeted groove, and each of said second complementary portions having a length longer than each of said second tenons so as to enable said second complementary portion to function to guide the insertion of said second tenon into said fourth rabbeted groove as said second complementary portion is inserted into said third rabbeted groove.

10. The security panel door as set forth in claim 9 wherein said first plurality of surround components comprises a pair of spaced frame members each having its longitudinal axis extending in a first direction.

11. The security panel door as set forth in claim 10 wherein said second plurality of surround components comprises three spaced frame members each having its longitudinal axis extending in a second direction, said second direction being substantially at right angles to said first direction.

* * * * *